US006739961B2

(12) United States Patent
Haney

(10) Patent No.: US 6,739,961 B2
(45) Date of Patent: May 25, 2004

(54) ABRASIVE BAND TIGHTENING APPARATUS

(76) Inventor: Donald E. Haney, 11376 Ramsey Rd., Gold Hill, OR (US) 97525

( * ) Notice: Subject to any disclaimer, the term of this patent is extended or adjusted under 35 U.S.C. 154(b) by 0 days.

(21) Appl. No.: 10/211,974

(22) Filed: Aug. 2, 2002

(65) Prior Publication Data

US 2003/0143934 A1 Jul. 31, 2003

Related U.S. Application Data

(60) Provisional application No. 60/309,830, filed on Aug. 2, 2001.

(51) Int. Cl.[7] ..... B24D 45/00
(52) U.S. Cl. ..... 451/499; 451/514; 451/504
(58) Field of Search ..... 451/496, 499, 451/502, 512, 513, 514, 517, 504, 505

(56) References Cited

U.S. PATENT DOCUMENTS 2,278,564 A * 4/1942 Reid
2,565,286 A * 8/1951 Way
4,250,810 A * 2/1981 Fowler et al.
5,062,363 A * 11/1991 Reichel
5,074,210 A * 12/1991 Reichel
5,181,347 A * 1/1993 Green
5,492,498 A * 2/1996 Casillas et al. ..... 451/496
5,842,913 A * 12/1998 Nemazi ..... 451/499

* cited by examiner

*Primary Examiner*—Eileen P. Morgan
(74) *Attorney, Agent, or Firm*—Kolisch Hartwell, P.C.

(57) ABSTRACT

An abrasive drum, suitable for polishing or sanding a workpiece, that incorporates an internal expansion member, configured so that when a belt of abrasive material fitted to the exterior cylindrical surface so that a loop of the band is disposed around the internal expansion member, expansion of the member tensions the abrasive band against the surface of the drum. The invention includes the abrasive drum, a sander or polisher that incorporates the abrasive drum, and a method of using the drum of the invention to grind, shape, polish, or sand a workpiece.

15 Claims, 2 Drawing Sheets

Fig. 3
Fig. 3A
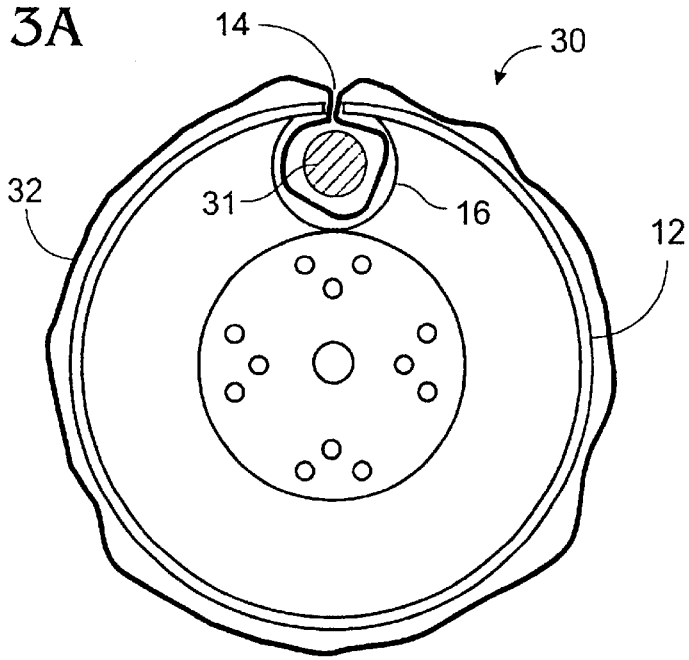
Fig. 3B
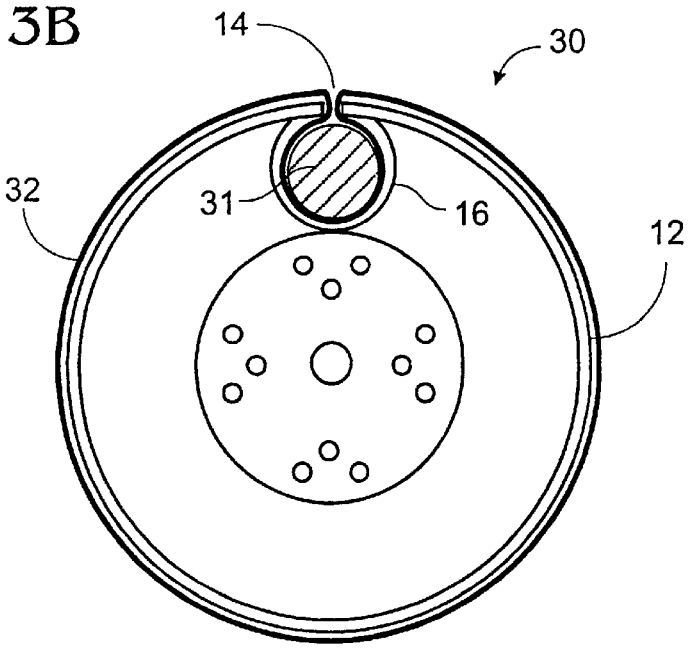
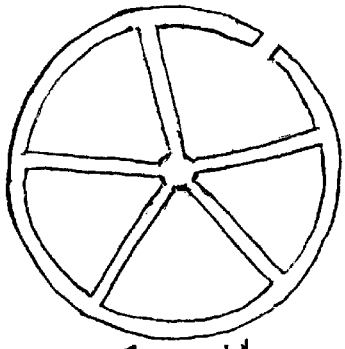
Fig. 4

ABRASIVE BAND TIGHTENING APPARATUS

CROSS-REFERENCE TO RELATED APPLICATIONS

This application is based upon and claims priority under 35 U.S.C. §119 from U.S. Provisional Patent Application Serial No. 60/309,830, filed Aug. 2, 2001, which is incorporated herein by reference in its entirety for all purposes. The following patents and patent applications are hereby incorporated by reference: application Ser. No. 08/993,699 filed Dec. 18, 1997; application Ser. No. 08/477,069 filed Jun. 7, 1995, now issued as U.S. Pat. No. 5,702,287; application Ser. No. 08/260,360 filed Jun. 15, 1994, now issued as U.S. Pat. No. 5,443,414; application Ser. No. 08/006,379 filed Jan. 19, 1993, now issued as U.S. Pat. No. 5,321,913; application Ser. No. 07/787,897 filed Nov. 5, 1991, now issued as U.S. Pat. No. 5,181,342; and application Ser. No. 07/568,902 filed Aug. 17, 1990, now issued as U.S. Pat. No. 5,081,794.

FIELD OF THE INVENTION

The invention relates to rotating abrasive drums used for sanding or polishing. More particularly, the invention relates to an apparatus for tensioning an abrasive belt against the surface of a rotatable drum so that it is securely held against the drum.

BACKGROUND OF THE INVENTION

The present invention relates to an abrasive drum that carries on its outer surface a band of abrasive material, so that when the drum is rotated it is useful for sanding or polishing. Such abrasive drums are used for a variety of applications, including coarse sanding, finish sanding, grinding, rough polishing, and dry finishing.

Such drums typically retain abrasive materials in one of two ways. The first type incorporates an expandable drum onto which an abrasive sleeve is fitted. The second type of drum features a slot in the outer surface of the drum through which the ends of a sheet of abrasive paper or abrasive cloth are inserted and retained. Unfortunately, there are problems with both types of drums.

Expandable drums require the use of expensive abrasive sleeves that are sized to fit only a single size of drum. Even though the sleeves are fitted appropriately, the abrasive sleeves will still slip against the drum, particularly when the friction of the sanding or polishing exceeds the friction between the sleeve and the drum.

Drums that utilize abrasive sheets typically include an axial slot in the outer surface of the cylinder through which the two ends of the abrasive sheet are inserted. Typically some type of clamp or clip is placed within the cylinder itself to secure the ends of the abrasive sheet. However, even if the ends are securely fastened, wear and tear on the sheet result in gradual slackening of tension and slipping of the abrasive on the drum, typically resulting in tearing of the abrasive sheet.

Some abrasive drums have included elaborate internal mechanisms for tensioning the sheet of abrasive. However such tensioning apparatus are generally complicated, incorporating springs and counterweights, and often relying upon the centrifugal force that is exerted when the drum is spinning to maintain tension on the abrasive band. Such mechanisms tend to complicate the process of changing abrasive bands.

In contrast, the abrasive drum of the invention permits a wide variety of abrasive band sizes to be fitted snugly to a single size drum. Abrasive bands can be changed simply and quickly. Further, once fitted to the drum, each band is held snugly, and the appropriate band tension is maintained even when the drum is at rest.

SUMMARY OF THE INVENTION

The present invention includes a drum suitable for polishing or sanding a workpiece. The drum incorporates an internal expansion member disposed adjacent to and in communication with an axially extending slot in the cylindrical surface of the drum, configured so that when an abrasive belt is fitted to the exterior cylindrical surface so that a loop of the band is inserted through the axially extending slot and disposed around the internal expansion member, subsequent expansion of the member tensions the abrasive band against the surface of the drum, holding it securely.

The invention includes the drum of the invention, a method of applying an abrasive band to the drum of the invention, a sander or polisher that incorporates the drum of the invention, and a method of using the drum of the invention to grind, shape, polish, sand, or otherwise modify the surface of a workpiece.

The advantages of the present invention will be understood more readily after a consideration of the drawings and the Detailed Description.

BRIEF DESCRIPTION OF THE DRAWINGS

FIG. 3 is a schematic demonstrating the utility of the expansion member in tensioning an abrasive belt around the exterior of a drum of the invention. FIG. 3A shows an abrasive belt loosely applied to the drum of the invention. FIG. 3B shows the same abrasive belt and drum after the circumference of the expansion member is increased, tightening the abrasive belt on the drum.

FIG. 4 is a schematic cross end view of a drum embodiment of the present invention having rigid internal support structures oriented radially relative to the rotational axis.

DETAILED DESCRIPTION AND BEST MODE OF THE INVENTION

The invention includes a drum that is a rotatable cylinder having an external cylindrical surface and an axis of rotation, where the cylindrical surface includes an axially extending slot. Within the cylinder, and open to the axially extending slot is an expansion member chamber that encloses an expansion member that itself has an axis that is parallel to the axis of rotation of the cylinder. The expansion member is configured so that it can be reversibly enlarged so as to increase the circumference of the expansion member in the planes orthogonal to its axis.

The drum optionally further includes an abrasive band that is disposed around the external cylindrical surface, where a loop of the abrasive band is inserted through the axially extending slot and surrounds the expansion member within the expansion member chamber. This configuration permits the abrasive band to be tensioned against the external surface of the cylinder so that it is held firmly.

The invention also provides a method of applying an abrasive band to a cylindrical drum of the invention, by providing an abrasive band, and providing a drum that is a rotatable cylinder having an external cylindrical surface and an axis of rotation, where the cylindrical surface includes an axially extending slot, and where within the cylinder and adjacent to the axially extending slot is the expansion member chamber that houses an expansion member having an axis that is parallel to the axis of rotation of the cylinder. The method further includes the step of disposing the abrasive band around the external surface of the cylinder so that a loop of the abrasive band is inserted through the axially extending slot and surrounds the expansion member, and the step of enlarging the expansion member so that the abrasive band is tensioned against the surface of the cylinder.

Figure 1:
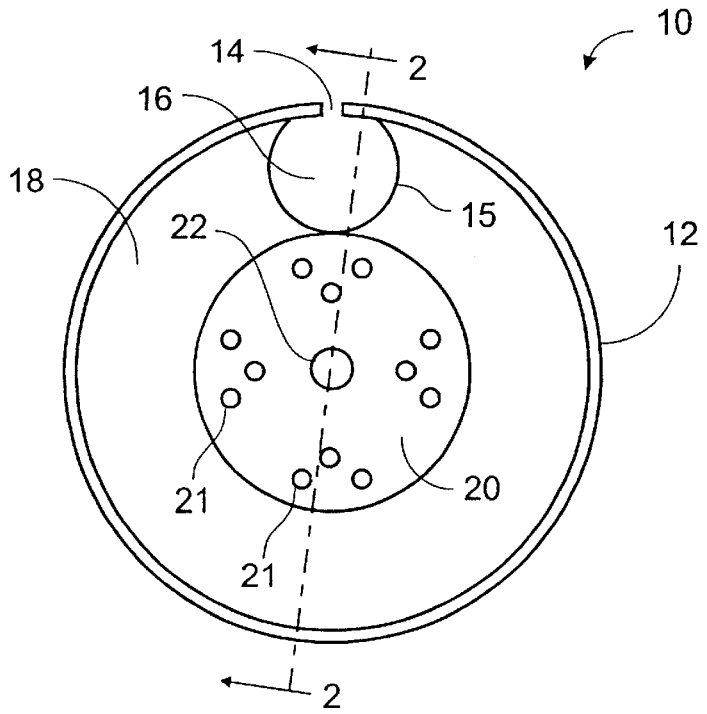
FIG. 1 is an end view of a drum according to the present invention.

An end view of a drum of the invention 10 is shown in FIG. 1. The drum includes an external cylindrical surface 12 and two end faces 18. The drum rotates about an axis of rotation that is coincident with a shaft 22. Typically, each face includes a shaft 22, so that the resulting drum is axially supported at each face. However, where the drum is sized to be operated in conjunction with a hand tool, it may possess only a single shaft or shank at one face. A single shaft 22 may pass completely through the drum and protrude from each drum end face. Alternatively, each end face may incorporate individual shafts therein. Shaft 22 optionally incorporates bushings or other fittings to facilitate connection of the drum to a drive belt or other drive means. Shaft 22 further optionally incorporates a threaded receiver or other connection at the end of the shaft to facilitate attachment of the drum to the frame of a stationary sander or polisher.

Figure 2:
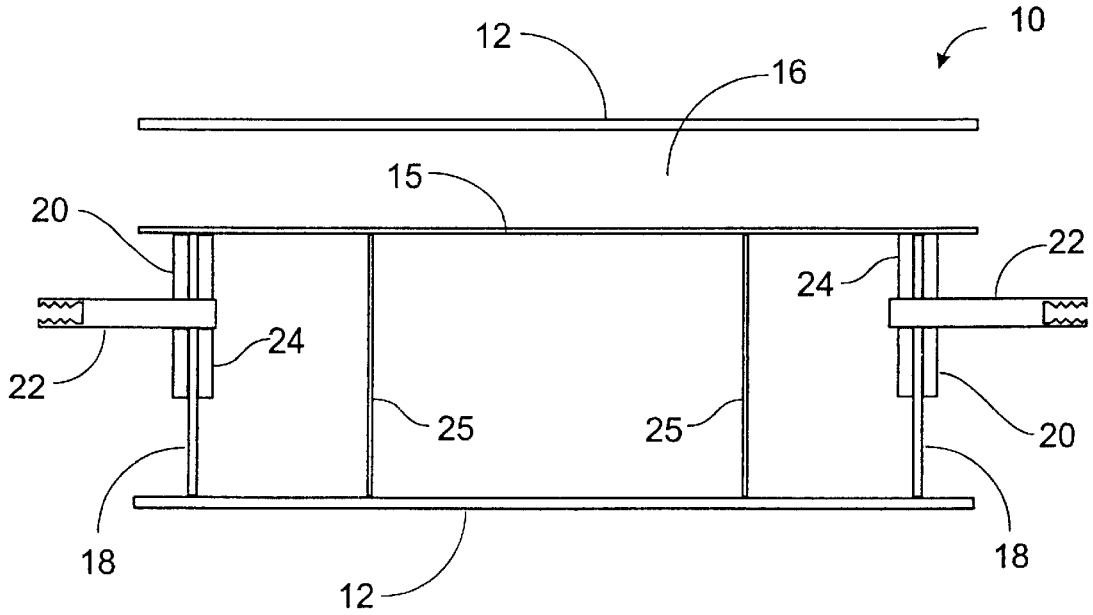
FIG. 2 is a cross section view of a drum according to the invention, as indicated in FIG. 1.

As shown in the drum embodiment provided in FIGS. 1 and 2, shaft 22 is attached to end face 18 by means of plates 20 and 24, that serve to sandwich a portion of end face 18 therebetween. Plates 20 and 24 (and therefore shaft 22) is securely attached by a plurality of fasteners 21. This sandwich construction confers strength and durability on the resulting drum, and permits efficient transfer of drive motion to the drum.

The cylindrical surface 12 includes an axially extending slot 14, that extends for at least a portion of the length of the cylinder. The slot may extend for substantially the entire length, or the entire length, of surface 12. Slot 14 is preferably substantially parallel to the axis of rotation of the drum, and is typically narrow in proportion to the drum itself. The slot may also be diagonal or curved relative to the rotational axis of the drum. In a preferred embodiment, a drum having an outer diameter of sixteen inches incorporates a surface slot having a width of less than or equal to one-eighth of an inch. The axial slot 14 permits access to an expansion member chamber 16 that is defined by chamber wall 15 located within the drum itself, in communication with slot 14. The expansion member chamber 16 also extends axially, and may extend the entire width of the drum to as to form a tube or pass through in the drum. Chamber 16 may have a diameter of approximately four inches.

The nature of the expansion member chamber 16 is perhaps more clearly understood with reference to the cross section view of drum 10 shown in FIG. 2. As shown, chamber 16 extends throughout the length of drum 10, and is open at each end of the drum. Also shown more clearly in FIG. 2 is the attachment of shaft 20 by connection to plates 20 and 24 that form a sandwich construction around end face 18.

Although chamber 16 is depicted as having a grossly cylindrical shape, any shape and size of expansion member chamber is suitable, provided that the chamber is disposed within the cylinder adjacent to the slot 14, and provided that it is sized to accommodate the expansion member used.

Selection of appropriate materials and dimensions for the drum of the invention is dependant on the manner of using the drum. In one embodiment of the invention, the cylinder surface is composed of aluminum having a thickness of one-half inch, and each end face is aluminum plate having a thickness of one inch. The drum optionally incorporates internal gussets 25, as shown at FIG. 2, that are optionally fashioned from aluminum plate. Fasteners 21 may be any type of fastener that securely joins plates 20 and 24 to end face 18 (and thereby secures shaft 22 to the drum), including any of a variety of suitable rivets, bolts, or screws.

The drum of the invention further includes an expansion member. The expansion member is disposed within the expansion member chamber, and similarly possesses an axis that is parallel to the axis of rotation of the cylinder. The expansion member is configured so that it can be reversibly enlarged. More specifically, the expansion member can be enlarged in such a way that the circumference of the expansion member is increased in the planes orthogonal to the axis of rotation of the cylinder.

To use the drum of the invention, an abrasive band that is a loop of abrasive material having a width that is the same or less than the drum of the invention is disposed around the external cylindrical surface of the drum in such a way that a loop of the abrasive band is inserted through the axially extending slot in the surface and surrounds the expansion member. This may be most readily accomplished by placing the band into the appropriate conformation to slide into place from one end of the drum. Alternatively, the band is placed onto the drum, and a loop inserted into the expansion member chamber 16, and then the expansion member is slid into place within the loop from one end of the drum. In either event, the expansion member is initially configured to have a minimal circumference. Once the drum, the abrasive band, and the expansion member are appropriately placed with respect to each other the expansion member is enlarged, tensioning the abrasive band against the external surface of the cylinder so that it is held firmly.

The operation of the expansion member is shown more clearly in FIG. 3. FIG. 3A shows an abrasive band 32 appropriately placed around the surface of the drum 12, and having a loop inserted through slot 14 and disposed around expansion member 31. The abrasive band is slack. Upon expansion of member 31, the abrasive band 32 is tensioned around the entire circumference of the drum, and the drum is ready for use to polish or sand a desired article.

Where the expansion member fits snugly within the expansion member chamber, a lid or cover for the chamber is not required, as friction will retain the expansion member in place during use. Alternatively, the expansion member is retained with the expansion member chamber by a lid, cover, or face plate that partially or completely covers the opening of the expansion member chamber in the end face of the drum. Such a lid, cover, or face plate is preferably readily attached or removed to facilitate changing abrasive bands or adjusting the expansion member.

The expansion member is preferably enlarged by a completely reversible mechanism, and the enlarged member should preferably exhibit some resilience to applied tension, so that some stretching of the abrasive band does not result in a loss of tension of the band. Further, the expansion member is preferably somewhat compressible, so that sudden stresses that may be applied to the abrasive band are absorbed without tearing the band.

In one aspect of the invention, the expansion member includes two semi-cylindrical halves that are urged apart by a spring or cam mechanism. Preferably, the expansion mechanism is graduated, so that a variety of different belt sizes can be accommodated by the drum of the invention.

In a preferred aspect of the invention, the expansion member is a bladder that is expanded by filling the bladder with a fluid including liquid or gas. Preferably, the bladder is filled with a gas. In this embodiment of the invention, the bladder incorporates a valve, for example, such as a valve on a bike or car tire, for filling the bladder and optionally relieving the bladder pressure. Alternatively, the bladder incorporates one valve for filling the bladder, and a second valve for relieving pressure. Either valve optionally incorporates a safety valve so that the bladder is prevented from overpressurization and the risk of rupture of the bladder membrane. Alternatively, the bladder incorporates a separate safety valve mechanism. Typically, the bladder is an air bag. The bladder is generally made of a natural or synthetic polymer that will provide the desired performance characteristics, as described above. Typical bladder materials include plastic and/or rubber compositions.

The bladder is typically cylindrical, and sized to match or compliment the expansion member chamber of the drum of the invention. The use of a bladder offers several advantages with respect to tensioning the abrasive belt on the drum. The bladder is substantially adjustable, simply by metering the amount of gas or liquid used to fill the bladder. By appropriate inflation of the bladder a wide variety of belt sizes can be accommodated on the drum of the invention. Alternatively, a given drum can have more than one expansion member to accommodate abrasive bands of widely differing sizes. That is, a small bladder for smaller bands, and a large bladder where a larger band is used. In addition, a suitably elastic bladder possesses inherent resilience, facilitating the application of a gentle and constant tension on the band during use, yet able to accept additional momentary stresses that might otherwise result in damage to the abrasive band.

The abrasive drum of the invention is typically incorporated in a sander or polisher. Where the sander is a free-standing or industrial sander, it typically includes a frame, a conveyor, the abrasive drum of the invention, and a drive belt or other means of rotating the abrasive drum. The conveyer typically feeds a workpiece toward and then past the abrasive drum, so that a surface of the workpiece is sanded or polished by the action of the abrasive band that is present on the rotating drum surface. Alternatively, the drum of the invention is rotated around a vertical axis, and the workpiece is applied to the drum by hand, typically useful for smaller pieces or curved surfaces. In yet another embodiment, the drum is sized appropriately to be incorporated into a hand tool, such as a hand sander, and the abrasive drum is applied to the workpiece manually.

The workpiece may be made of wood, metal, stone, plastic, or other natural or synthetic material, and the choice of abrasive band is therefore highly dependent upon the material being sanded and the nature of the finish desired. Different abrasives can be used to achieve different results. For example, a coarse grit abrasive is used to abrade quickly and deeply. A fine grit abrasive is typically used to produce a final, desired smoothness.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances apparent to an artisan of ordinary skill.

I claim:

1. A sanding drum assembly comprising a drum structure having a substantially cylindrical outer surface, an opening in the surface of the drum for receiving a portion of an abrasive belt to form a loop of the abrasive belt inside the drum structure, and an expansion member configured to be expanded inside the loop of the abrasive belt so that the abrasive belt is tightly secured around the outer surface of the drum structure.

2. The drum assembly of claim 1, wherein the opening is substantially linear.

3. The drum assembly of claim 1, wherein the opening has a length approximately equal to the width of the abrasive belt.

4. The drum assembly of claim 1, wherein the drum structure has a rotational axis, and the opening has a long axis parallel to the rotational axis of the drum structure.

5. The drum assembly of claim 1 further comprising an air source connected to the expansion member.

6. The drum assembly of claim 1 further comprising a drive mechanism configured to drive rotation of the drum structure.

7. The drum assembly of claim 1 further comprising a conveyor for transporting a work piece in a conveyor direction adjacent the drum structure.

8. The drum assembly of claim 7, wherein the drum structure is oriented substantially perpendicular to the conveyor direction.

9. The drum assembly of claim 7, wherein the drum structure is oriented obliquely relative to the conveyor direction.

10. The drum assembly of claim 7 further comprising a drive mechanism that moves the drum structure in at least one nonlinear motion relative to a work piece being transported by the conveyor.

11. The drum assembly of claim 1, wherein the expansion member includes an inflatable bladder.

12. The drum assembly of claim 1, wherein the drum structure has a rigid inner compartment connected to the opening, the expansion member being housed in the inner compartment of the drum structure.

13. The drum assembly of claim 1, wherein the opening is in the form of a linear slot.

14. The drum assembly of claim 1, wherein the opening is in the form of a curved slot.

15. A sanding drum assembly comprising a drum structure having a substantially cylindrical outer surface, an expansion member chamber disposed within the drum structure, an opening in the surface of the drum providing access to the expansion member chamber, an endless abrasive belt disposed around the drum structure such that a loop of the endless abrasive belt is inserted into the expansion member chamber through the opening, and an expansion member disposed within the expansion member chamber, wherein the expansion member is configured to be expanded inside the loop of the abrasive belt so that the abrasive belt is tightly secured around the outer surface of the drum structure.

* * * * *